US006110017A

United States Patent [19]

Savoie et al.

[11] Patent Number: 6,110,017

[45] Date of Patent: Aug. 29, 2000

[54] METHOD AND APPARATUS FOR POLISHING OPHTHALMIC LENSES

[76] Inventors: Marc Y. Savoie, 166 Maple Street, Moncton, New Brunswick, Canada, E1C 6A4; Gary V. Underhill, 21 Gibson Road, Moncton, New Brunswick, Canada, E1E 2K3

[21] Appl. No.: 09/391,500

[22] Filed: Sep. 8, 1999

[51] Int. Cl.[7] ..... B24B 1/00

[52] U.S. Cl. ..... 451/42; 451/323; 451/325; 451/384; 451/390

[58] Field of Search ..... 451/159, 325, 451/323, 384, 390, 495, 42, 36, 37

[56] References Cited

U.S. PATENT DOCUMENTS

| | | | |
|---|---|---|---|
| 3,589,071 | 6/1971 | Hirschborn . | |
| 4,606,151 | 8/1986 | Heynacher . | |
| 4,802,309 | 2/1989 | Heynacher . | |
| 4,850,152 | 7/1989 | Heynacher et al. . | |
| 5,175,961 | 1/1993 | Bolton . | |
| 5,205,083 | 4/1993 | Pettibone | 451/390 |
| 5,345,725 | 9/1994 | Anthony | 451/390 |
| 5,662,518 | 9/1997 | James et al. . | |

*Primary Examiner*—David A. Scherbel
*Assistant Examiner*—Shantese McDonald
*Attorney, Agent, or Firm*—Mario D. Theriault

[57] ABSTRACT

The invention pertains to an improved method, a lapping tool head and a lens polishing apparatus for carrying out the method, for polishing ophthalmic lenses. The apparatus has a lapping tool head, a flexible membrane covering a lapping portion of the tool head, and pump and nozzle for pumping abrasive slurry over the lapping tool head. The new method comprises the conventional step of imparting an oscillatory movement to the lapping tool head and contacting the lens surface with the lapping portion of the lapping tool head while an abrasive slurry is pumped over the lapping tool head. The improvement comprises the additional step of periodically undulating the membrane for imparting a wave in that membrane such that the abrasive slurry can flow between the membrane and the lens surface. The lapping slurry is efficiently moved over the entire surface of the lens for improving the quality of the lenses polished by this process.

20 Claims, 7 Drawing Sheets

METHOD AND APPARATUS FOR POLISHING OPHTHALMIC LENSES

FIELD OF THE INVENTION

This invention pertains to the polishing of ophthalmic lenses, and more particularly, it pertains to a method and an apparatus for polishing ophthalmic lenses, using a lapping tool having a dynamically formable lapping membrane.

BACKGROUND OF THE INVENTION

A primary requirement in the optical industry in regard to apparatus for polishing ophthalmic lenses, is the ability to improve the surface finish of a lens without changing the curvature of the lens' surfaces. Ideally, a lens polishing operation is limited to the removing of minor scratches and machining marks in a lens while maintaining perfectly the prescribed curvatures. It will be appreciated that any uncontrolled pressure point in a lapping membrane of a lapping tool head, or a depletion of polishing slurry at any location over the membrane can cause the polishing operation to remove more or less material in one region of the lens, thereby changing the prescribed curvature of that lens and causing optical defects.

Many types of lens polishing apparatus have been developed in the past and were used with varying degrees of success. These apparatus are believed to belong to two broad groups. The first group utilizes a lapping tool head having a resilient or flexible lapping membrane which is deformable upon contact with the surface of a lens to adapt to the curvature of the lens. Examples of apparatus belonging to this first group are described in the following U.S. Patents: U.S. Pat. No. 3,589,071 issued on Jun. 29, 1971 to Hans S. Hirschhorn; U.S. Pat. No. 5,205,083 issued on Apr. 27, 1993 to Dennis R. Pettibone; U.S. Pat. No. 5,662,518 issued on Sep. 2, 1997 to Michael D. James et al.

The second type of lens polishing apparatus of the prior art uses a plurality of plungers for applying pressure gradients over a lens polishing membrane. Although these apparatus are designed for polishing large telescope mirrors, this is the type of apparatus that is of interest herein. Examples of these apparatus are illustrated in the following U.S. Patents: U.S. Pat. No. 4,606,151 issued on Aug. 19, 1986 to Erich Heynacher; U.S. Pat. No. 4,802,309 issued on Feb. 7, 1989 to Erich Heynacher; U.S. Pat. No. 4,850,152 issued on Jul. 25, 1989 to Erich Heynacher et al.

The latter examples describe polishing apparatus having a plurality of actuators for applying different pressures at different areas of a polishing membrane. The different pressures are adjusted according to the amount of material to be removed at different locations on the lens surface, such that a polishing operation is effected more quickly. These apparatus have undeniable merits and are believed to be great advances in the polishing of optical surfaces.

However, these apparatus do not address the fact that a lens polishing operation is normally accompanied by the accumulation or depletion of abrasive slurry at certain regions of the lens surface, which can cause more or less polishing in these regions. Although this is a very common source of optical defects in ophthalmic lenses, there is no known prior art apparatus that offers a solution to the controlling of the movement of abrasive slurry between a polishing membrane and a lens surface.

SUMMARY OF THE INVENTION

In the present invention, however, there is provided a new method for polishing an ophthalmic lens. There is also provided a lapping tool head that is adapted to simultaneously conform to the shape of an ophthalmic lens and to move abrasive slurry between the membrane thereof and the ophthalmic lens being polished.

Broadly, in accordance with one feature of the present invention there is provided an improved method for polishing an ophthalmic lens surface using an apparatus having a lapping tool head, a flexible membrane covering a lapping portion of that tool head, and pump and nozzle means for pumping abrasive slurry over the lapping tool head. The new method comprises the conventional step of imparting an oscillatory movement to the lapping tool head and contacting the lens surface with the lapping portion of the lapping tool head while an abrasive slurry is pumped over the lapping tool head and on the lens. The improvement comprises the additional step of periodically undulating the membrane for imparting a wave in that membrane such that the abrasive slurry can flow between the membrane and the lens surface.

A major advantage of this new method is that the lapping slurry is efficiently moved over the entire surface of the lens for improving the quality of the lenses polished by this process.

In another feature of the present invention, the new method also includes the step of shaping the membrane along a pair of right angle axes and defining membrane profiles along these axes that are respectively similar to and aligned with a base and cross curvatures of the lens being polished. This shaping of the membrane ensures that a lapping operation is effected evenly without applying any pressure point or relaxed sector over the lapping portion of the lapping membrane.

In a further feature of the present invention, there is provided a lapping tool head for polishing ophthalmic lenses. The lapping tool head comprises a base plate having mounting means for securement thereof to a lens polishing apparatus, and a plurality of pneumatic fittings mounted in that base plate. A manifold plate is affixed to the base plate and has pneumatic circuits therein with each pneumatic circuit communicating with one of the pneumatic fittings. A plurality of pneumatic cylinders is affixed to the manifold plate, and defines a circular array of parallelly-aligned cylinders, with each cylinder being connected in a sealed communication with a respective one of the pneumatic circuits. A rigid shield encircles all the cylinders, and individually encloses a collar end of each cylinder, opposite the manifold plate.

There are also provided an elongated sleeve immovably affixed to the shield in a central region of the circular array, and being aligned with the cylinders, and a flexible membrane covering the cylinders and the shield. The membrane has a stem extending therefrom and into the sleeve and being secured into the sleeve. Each cylinder has an extendible end which is movable against the flexible membrane for shaping the membrane.

When the pneumatic fittings are adapted to be connected to respective sources of air pressure, the cylinders are individually controllable for shaping the membrane according to the curvatures of an ophthalmic lens. When the membrane is brought in contact with an ophthalmic lens, a central portion of the membrane is usable as a reference contact point for positioning the membrane against the ophthalmic lens with a selected pressure between the membrane and the lens' surface.

In accordance with another feature of the present invention, the array of cylinders in the lapping tool head comprises an inner and outer concentric circles around the sleeve. Thus, when the cylinders in each circles are periodically actuated separately, the membrane is undulated in circular waves for advantageously moving lapping slurry over the surface of the lens.

In yet another feature of the present invention, the array of cylinders is divisible in four diametrically opposite segments of the tool head, and the cylinders in each pair of opposite segments are operable in a group for generating radial waves in the membrane for the purpose of moving lapping slurry over the surface of the lens.

In yet a further aspect of the present invention, the array of cylinders comprises two concentric circles. Each cylinder has an extendible end, and the extendible ends on the cylinders in the outer circle have D-shaped pads mounted thereon, with a short segment of the pad extending along a circumference of the circular array, and each pad being pivoted on a respective extendible end, along an axis which is also aligned with the circumference of the circular array.

The extendible ends in the cylinders in the inner circle have suction-cup-shaped caps mounted thereon. The suction caps are optionally connectional to a source of a vacuum as well as the cylinders in the inner circle. Therefore when the cylinders in the outer circle are connected to a source of pressure and the cylinders in the inner circle and the suction caps are connected to a source of a vacuum, this array of cylinders is usable for shaping the membrane according to extreme lens curvatures.

Still another feature of the present invention is that the array of cylinders is a compact arrangement that is substantially similar to an area defined by a common ophthalmic lens blank. The array of cylinders is mountable in a tool head that has a common size and that is adaptable to conventional lens lapping and polishing apparatus, for retrofitting an existing lens polishing apparatus for example, thereby making such lapping tool head economically available to the optical industry.

BRIEF DESCRIPTION OF THE DRAWINGS

One embodiment of this invention is illustrated in the accompanying drawings, in which like numerals denote like parts throughout the several views, and in which.

DETAILED DESCRIPTION OF THE PREFERRED EMBODIMENT

Figure 2:
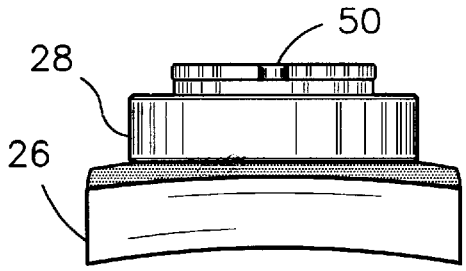
FIG. 2 is a side view of an ophthalmic lens mounted on a support block.

While this invention is susceptible of embodiments in many different forms, there is shown in the drawings and will be described in details herein, a specific embodiment of the apparatus according to the present invention and a method of use of the apparatus, with the understanding that the present disclosure is to be considered as an example of the principles of the invention and is not intended to limit the invention to the embodiment illustrated and described.

Figure 1:
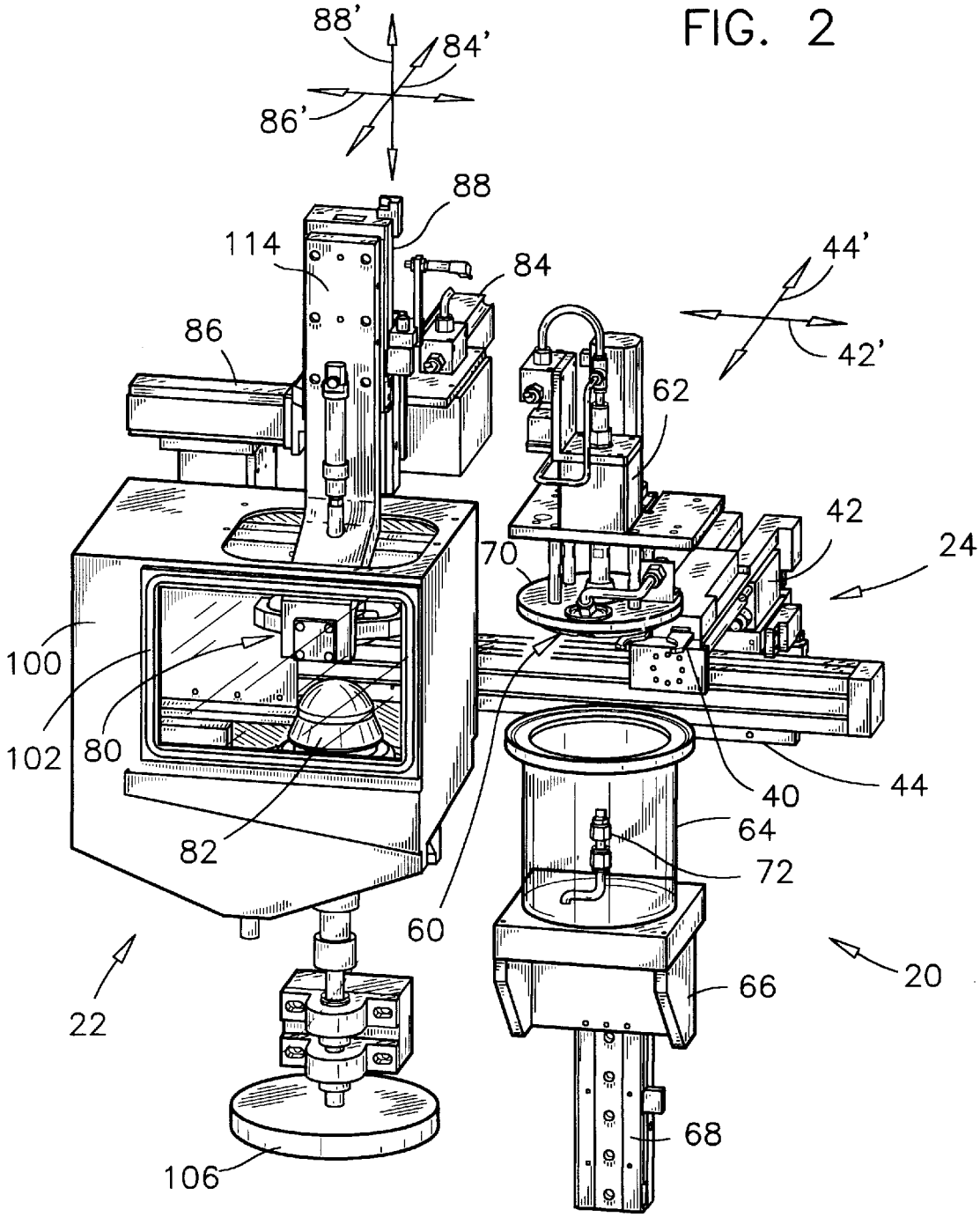
FIG. 1 a simplified illustration of a lens polishing apparatus according to the preferred embodiment of the present invention. For more clarity, the apparatus is shown without the usual drive motor, control equipment, cabinetry and other equipment common to this type machines.
Figure 3:
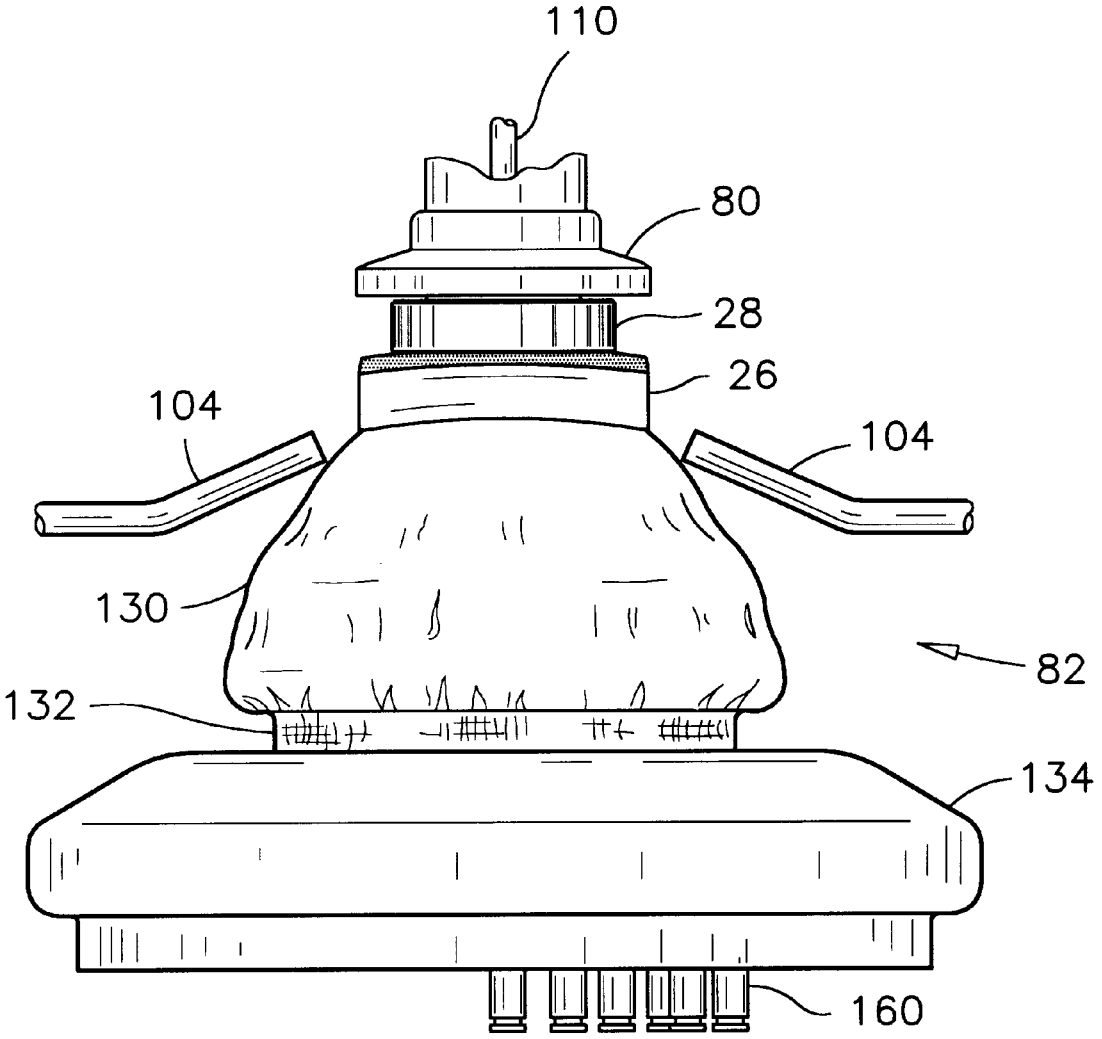
FIG. 3 is s a closeup view of the lapping tool head comprised in the lens polishing apparatus.

Reference will firstly be made to FIGS. 1, 2 and 3 illustrating respectively, a simplified perspective view of the apparatus according to a preferred embodiment of the present invention, for carrying out a new method for polishing ophthalmic lenses, a typical ophthalmic lens mounted on a support block, and a lapping tool head incorporated in the apparatus. However, before describing this apparatus in detail, it is deemed that certain general information should be reminded in order to afford a clearer understanding of the diagram of FIG. 1. The polishing of ophthalmic lenses referred to herein pertains to an optional step in the manufacturing of ophthalmic lenses on an ultra-precision lens generating apparatus wherein the final curvature of a lens' surfaces is determined by a machining process and shall not be altered during the polishing operation. The polishing of ophthalmic lenses is a light lapping operation which is optionally carried out to remove invisible or hardly visible machining defects from the lens' surfaces, in order to produce lenses of a finest quality. The polishing of the lenses is carried out prior to applying an optional final clear resinous coating to the lenses.

According to the above, it will be appreciated that during such polishing operation, it is important to remove material from the lens' surface in a precise and controllable manner in order to obtain predictable results. That is, basically, the major objective of the apparatus and method according to the preferred embodiment.

The apparatus according to the preferred embodiment comprises in combination: a wash station 20; a polishing station 22 and a robotic manipulator 24 for transporting an ophthalmic lens 26 with a lens block 28 affixed thereto from a placement station (not shown) to the wash station 20; from the wash station 20 to the polishing station 22; and from the polishing station 22 back to the wash station and then to a placement station (not shown) where an operator can remove the lens 26 from the apparatus. It will be appreciated that the placement station (not shown) may be incorporated into the wash station, and the lens 26 and block 28 may be initially placed in the wash station 20 by an operator of the apparatus.

The robotic picker 24 comprises a gripper assembly 40, for engaging and holding the lens block 28, and a pair of a first and second linear actuators and slide assemblies 42,44 for moving the gripper assembly 40 in transversal and longitudinal directions respectively as indicated by arrow 42' and 44'. The robotic picker 24 is preferably also movable in up and down directions to grab and release a lens block 28. The lens 26 is preferably introduced in the wash station or in the lens placement station (not shown) by manually orienting a reference slot 50 with a corresponding indentation (not shown) in the chuck of one of these stations.

Referring back to FIG. 1, the wash station 20 comprises a first vacuum chuck 60 (similar to 80 in FIG. 3), for retaining the lens block 28. The first vacuum chuck 60 is mounted on the arbor of a rotary actuator 62 such that the lens 26 is rotatable during the wash cycle. There is also provided a wash basin 64 mounted on a first structure 66 which is actuated in up and down directions relative to the rotary actuator 62 by a third linear actuator and slide assembly 68. The first vacuum chuck 60 has a splash guard plate 70 movably attached thereto, and a spray nozzle 72 is mounted inside the wash basin 64. During the wash cycle, the wash basin 64 rises up against the splash guard plate 70 and encloses the lens 26, the lens block 28 and the spray nozzle 72 completely. Water or a mixture of water and detergent is then sprayed against the lens while the lens 26 rotates several turns. Upon completion of the wash cycle, the lens 26 is transferred to the polishing station 22 by the robotic picker 24.

The polishing station comprises a second vacuum chuck 80 for holding the lens 26 during the polishing cycle. The second vacuum chuck 80 is mounted above a lapping tool head 82 such that the surface of the lens 26 to be polished is oriented downward facing the top portion of the lapping tool head 82.

The second vacuum chuck 80 is mounted on a second structure which is only partly drawn for maintaining the clarity of the drawing. The second structure comprises a fourth, fifth and sixth linear actuators and slide assemblies 84,86 and 88 respectively. These linear actuator and slide assemblies are operable for moving the second vacuum chuck 80 in three orthogonal directions indicated by corresponding arrows 84', 86' and 88'. Such movements of the second vacuum chuck 80 are advantageous for initially positioning the geometrical center of the lens to coincide with the vertical neutral axis of the lapping tool head 82, or for initially positioning the lens a nominal offset distance relative to the neutral axis of the lapping tool head to accommodate a prism angle in that lens for examples. It is also recommended to continually moving the lens 26 back and forth and side to side in directions indicated by arrows 84' and 86' relative to the neutral axis of the lapping tool head during the polishing cycle to prevent localized over or under-polishing of the lens.

The second vacuum chuck 80 and the lapping tool head 82 are preferably mounted inside a sealable enclosure 100. The enclosure 100 preferably has a glass window 102, and the wash basin 64 is preferably made of transparent material such that both operations may be monitored by an operator standing near the apparatus.

A continuous flow of lapping slurry is pumped over the lapping tool head 82 and the lens 26 by one or more slurry nozzles as indicated by numeral 104 in FIG. 3.

The lapping tool head 82 of the apparatus is operated in a circular oscillatory movement by a mechanism of the type described, for example, in U.S. Pat. No. 5,175,961 issued on Jan. 5, 1993 to John R. Bolton. Rotary power is applied to the mechanism at pulley 106.

Referring particularly to FIG. 3, the vacuum chuck 80 and the lapping tool head 82 are illustrated therein in a larger scale. The second vacuum chuck 80 is only partly illustrated therein. The partial illustration is also used to maintain the clarity of the drawing. However, it will be appreciated that this chuck 80, as well as the first chuck 60, are operated by a vacuum and are connected to a source of a vacuum and appropriate control valves, by a conduit such as the one illustrated and identified by label 110.

Figure 4:
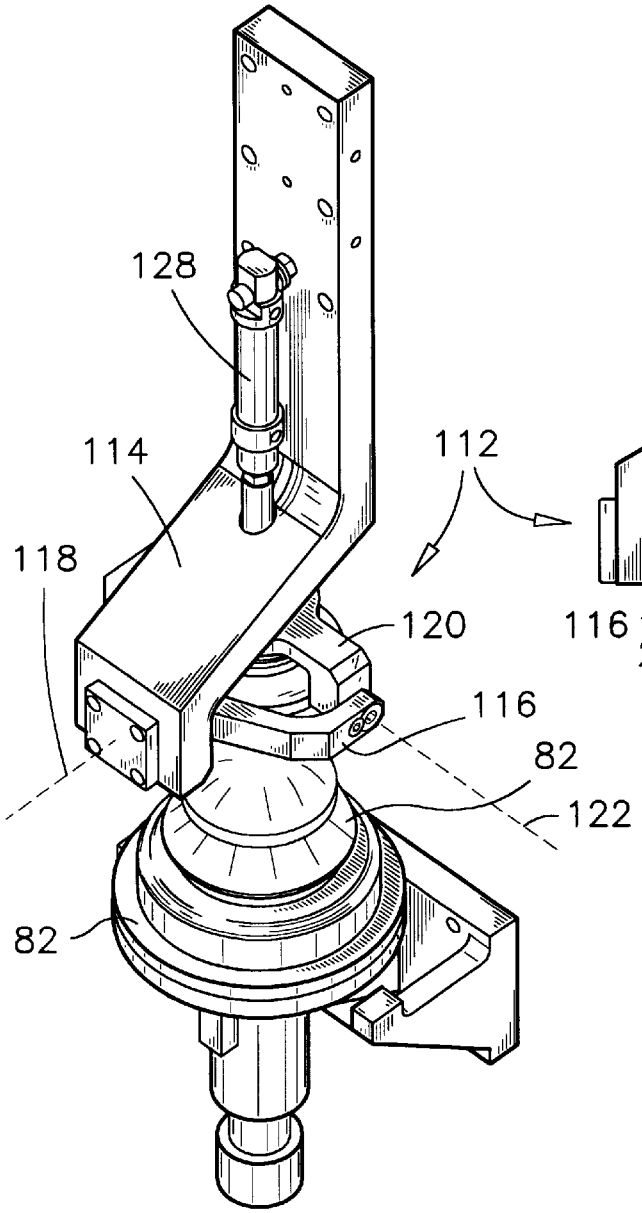
FIG. 4 is a partial perspective view of the polishing station inside the lens polishing apparatus.

In the apparatus according to the preferred embodiment, the vacuum chuck 80 is mounted on a gimbal 112, which in turn is mounted on a vertical brace 114 affixed to the sixth linear actuator 88. This preferred mounting is better illustrated in FIGS. 4 and 5.

The gimbal 112 comprises a first C-shaped member 116 which is pivoted at its center along a first axis of articulation 118 passing through a first bearing (not shown) in the vertical brace 114. A second C-shaped member 120 has its ends respectively connected to the ends of the first C-shaped member 116, along a second axis of articulation 122 perpendicular to the first axis 118.

Figure 5:
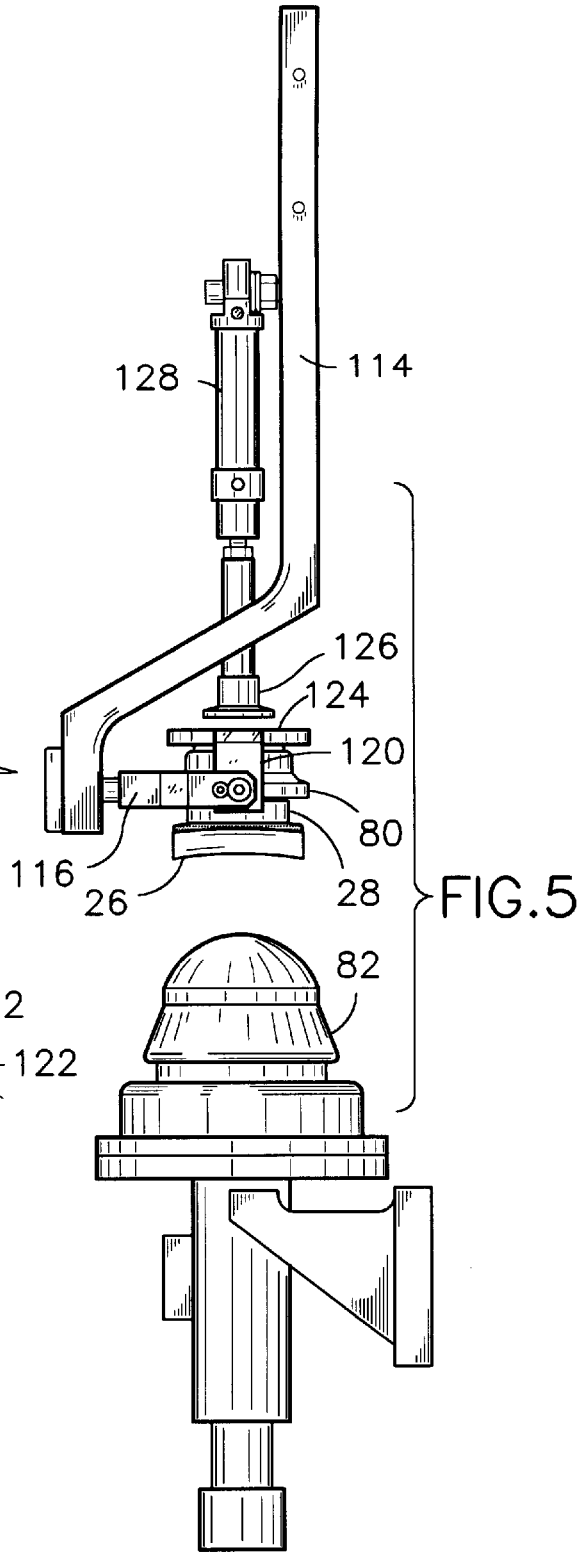
FIG. 5 is a partial side elevation view of the lens polishing station.

The second C-shaped member 120 has a flat surface 124 on an upper side thereof, as illustrated in FIG. 5. This flat surface is advantageously used for selectively contacting a stay member 126 there-against, for orienting and stabilizing the gimbal 112 during the insertion of a support block 28 in the chuck 80 or when removing a support block from the chuck. In the preferred apparatus, the stay member 126 is a flat-ended circular member mounted on the extension rod of a linear actuator 128.

Referring back to FIG. 3, the lapping tool head 82 is preferably covered by a fabric hat 130 enclosing the active part thereof completely. The fabric hat 130 is held about the tool head by an elastic band 132 below the enlarged portion of the tool head. The fabric material of the fabric hat 130 is selected such that it has good endurance and good characteristics related to the absorption and retention of lapping slurry. A preferred type of fabric material for use in manufacturing the fabric hat 130 is sold by DuPont$_{TM}$ under the trade name Wearforce$_{TM}$ "F". DuPont$_{TM}$, E.I. du Pont de Nemours and Company, has offices across the world with its corporate headquarters at: 1007 Market Street, Wilmington, Del., 19898, U.S.A.

It will be appreciated that, during operation of the apparatus of the preferred embodiment, when the lens 26 is held against the lapping tool head 82 and when abrasive slurry is pumped along the periphery of the lens, the central region of the lens 26 may be deprived from an abundant circulation of slurry, as compared to the peripheral regions of the lens for example.

It is known that the slurry has a liquid phase, normally water, and a solid phase comprising microscopic abrasive particles, normally aluminum oxide particles, typically of no more than five (5) microns in size. The purpose of the liquid phase is to carry the abrasive particles over the entire area to be polished, and to wash away the abraded particles of plastic or glass from the lens. However, it will be appreciated that when the lens is in full contact with the lapping tool head, the slurry is not distributed uniformly over the entire surface of the lens. This inconvenience can cause an uneven wear of the fabric hat 130 covering the lapping tool head 82. The uneven distribution of slurry across the entire surface of the lens can also cause an uneven polishing of the lens.

Figure 6:
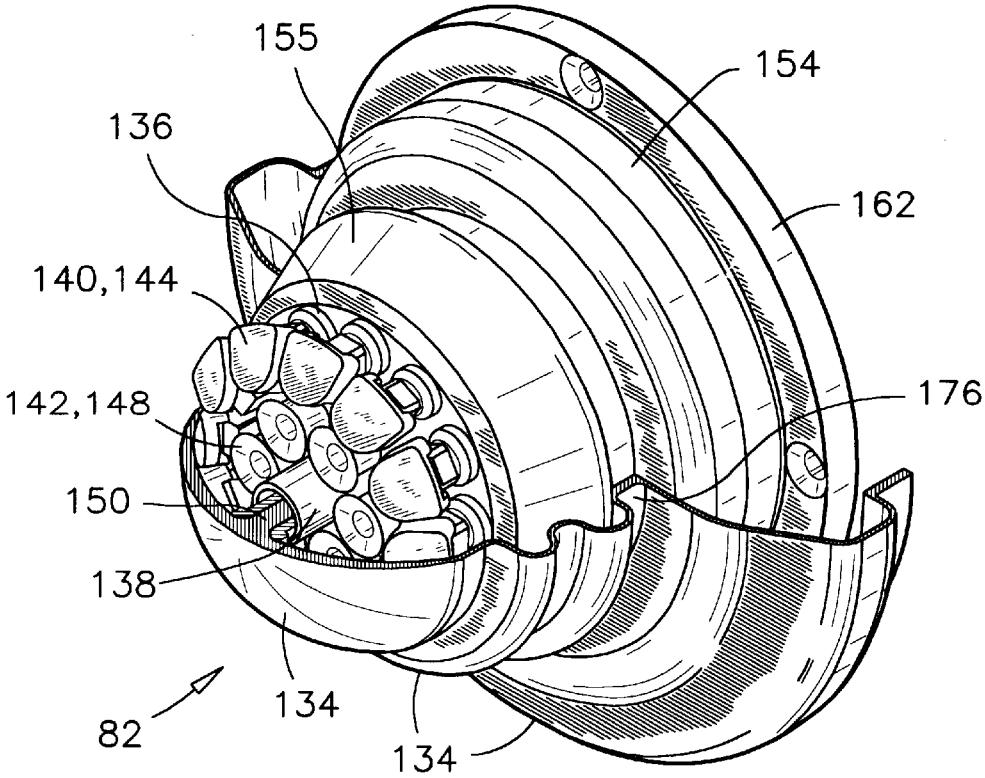
FIG. 6 is an enlarged perspective view of the lapping tool head of the lens polishing station, with the covering membrane thereof shown in a cut-away view.

In order to prevent these polishing defects, the lapping tool head 82 of the preferred embodiment has a curved membrane 134, as illustrated in FIGS. 3 and 6, and a number of pneumatic cylinders 136 mounted under the membrane for shaping the membrane according to the curvature of the lens 26, and for maintaining an even pressure distribution between the absorbent fabric hat 130, the membrane 134, and the entire surface of the lens 26. The membrane 134 is preferably made of a flexible rubber material that is water-impermeable, for preventing slurry from deteriorating the mechanisms and equipment associated with the pneumatic cylinders 136.

The pneumatic cylinders 136 of the lapping tool head 82 according to the preferred embodiment perform the additional functions of periodically undulating the membrane 134 for moving lapping slurry between the membrane and the lens 26.

Referring now simultaneously to FIGS. 6–11, the lapping tool head 82 of the apparatus of the preferred embodiment is described therein in greater details. The lapping tool head 82 comprises eighteen (18) pneumatic cylinders 136 disposed in a circular or hexagonal array around a central sleeve 138 . The circular or hexagonal array preferably has a diameter slightly smaller than a diameter of a standard lens blank. The array of pneumatic cylinders 136 comprises two concentric circles; the outside circle has twelve (12) outer plungers 140 and the inner circle has six (6) inner plungers 142.

In one version of the tool head 82, each pneumatic cylinder 136 is a single-action, spring-returned, collar-mount type, and the stroke length of each one is selected such that it operates in a mid-stroke region thereof over the entire range of adjustment of the lapping tool head. In this respect, the curvature of the membrane 134 of the lapping tool head of the apparatus according to the preferred embodiment is preferably adjustable from a slightly concave shape, about minus six (−6) diopters, to a planar configuration and to a convex curvature of about sixteen (16) diopters.

The rod end of each outer plunger 140 has a D-shaped pad 144, in which the short segment defines an arc along the circumference of the circular array. Each D-shaped pad 144 is pivoted to the rod end on a pin 146 (in FIG. 9) through the rod end and extending along the short segment mentioned above. This configuration of the pads 144 is advantageous for working the membrane 134 over its entire active area, and especially along the circumference thereof.

The rod ends of the inner plungers 142 preferably have vacuum-type cup-shaped caps 148. The shape of these caps 148 is advantageous for applying an even distribution of pressure under the membrane when the pneumatic cylinders 136 of these plungers are actuated outwardly. The shape of these cup-shaped caps 148 is also advantageous for optionally applying a vacuum thereto and a corresponding pulling force on the membrane for shaping the membrane into a flat configuration for example, or for undulating the membrane for moving polishing slurry thereunder, as will be explained later.

In this latter case, the pneumatic cylinders 136 operating the inner plungers 142 preferably have hollow rods communicating with a vacuum supply port, and are of the single-action spring-extended type. It will also be appreciated that the inner plungers 142 with the caps 148 mounted thereon are also connectional to a source of a vacuum while their respective cylinders 136 are connectional to a source of air pressure. In this configuration each cylinder has a vacuum and pressure ports; the vacuum port being connected to a hollow plunger rod and the pressure port being connected to the piston outside that rod. This configuration, however, has not been illustrated for being common to the persons skilled in pneumatic systems, and would be evident to these persons in the light of the present specification.

The central sleeve 138 is fixed relative the inner and outer plungers 140,142. It has a longitudinal axis extending in a parallel alignment with the axes of the pneumatic cylinders 136. The sleeve 138 defines a neutral axis of the tool head 82. The central sleeve 138 has an inside dimension for receiving and holding a stem 150 extending from the central region inside the membrane 134. The stem 150 is firmly retainable inside the sleeve 138 such that the stem 150 provides a reference point for shaping the membrane according to the surface to be polished. The stem 150 is preferably made of resilient rubber, as for the membrane 134 itself, and is bonded to or molded as an integral part of the membrane 134. The portion of the membrane near the stem 150 is positional against the lens, thereby providing a fixed base which is preferably maintained in contact with the surface of the lens, and from which the membrane may be profiled to match the curvatures of the lens being polished. The portion of the membrane near the stem 150 also provides a reference point for moving the lapping tool head 82 against a lens to be polished, when a pressure measuring device is used to control the movement of the sixth linear actuator 88. In that respect, the sixth linear actuator 88 preferably comprises a pneumatic linear actuator (not shown) that is connected to an adjustable high precision pressure regulator (not shown). This pneumatic equipment in combination with the stem 150, allows the operator of the lens polishing apparatus to precisely set a basic pressure between the lapping tool head 82 and the lens surface to be polished.

Figure 7:
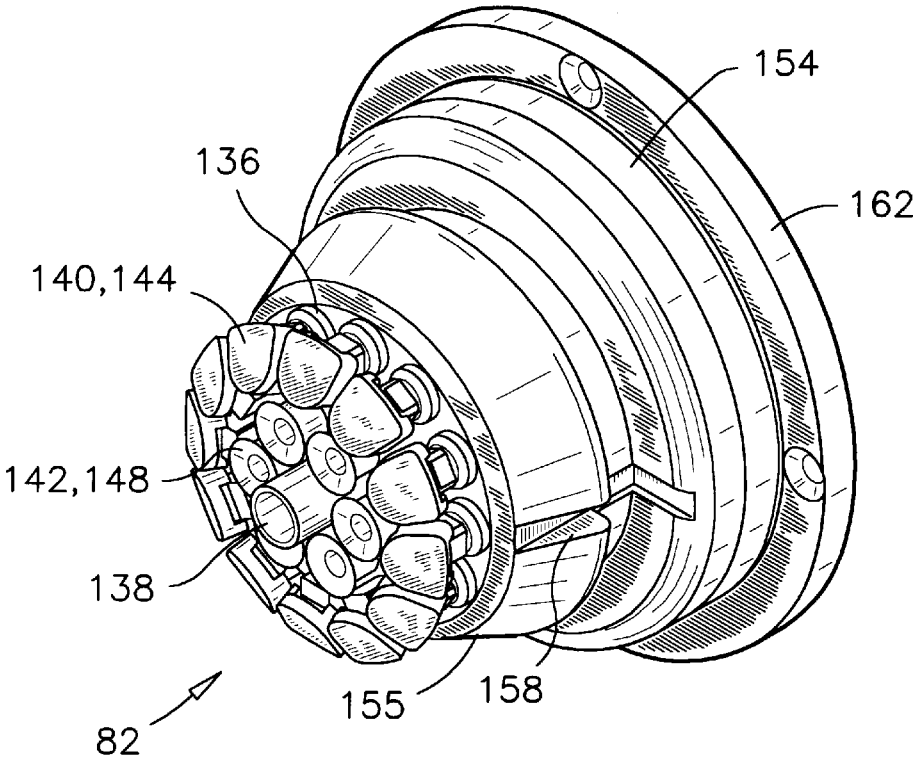
FIG. 7 shows the lapping tool head without the covering membrane.
Figure 9:
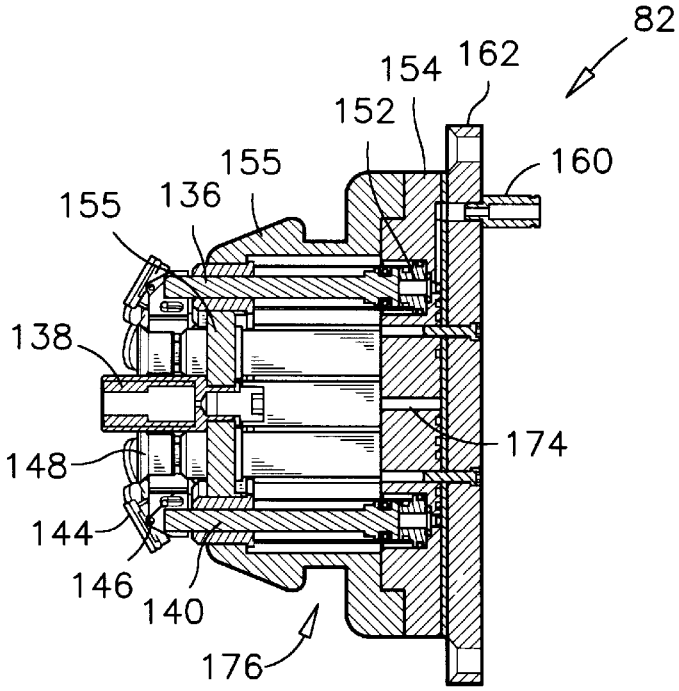
FIG. 9 is a cross-section view through the lapping tool head as seen along line 9—9,in FIG. 8.
Figure 10:
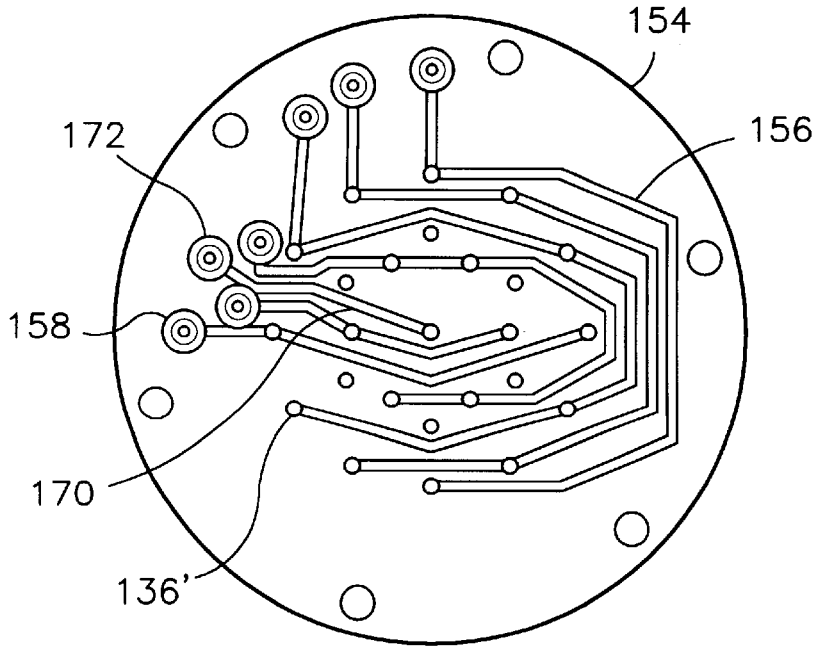
FIG. 10 is a plan view of the manifold plate incorporated in the base of the lapping tool head.
Figure 11:
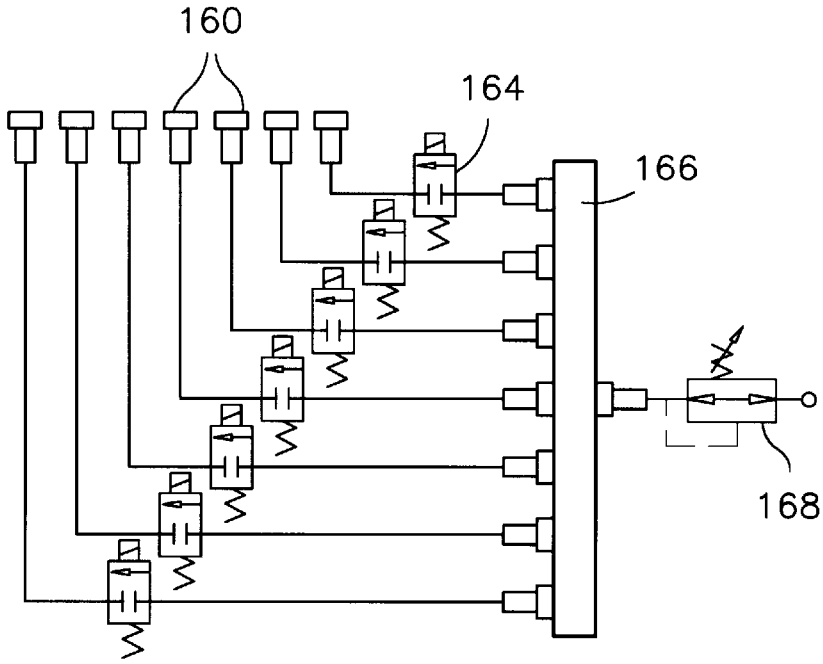
FIG. 11 is a pneumatic circuit diagram used in association of the lapping tool head.

Referring now particularly to FIGS. 7, 9 and 10, the ported end 152 of each cylinder 136 is seated in a manifold plate 154 and is sealed in a respective cavity in the manifold plate. The manifold plate 154 and the pneumatic cylinders 136 are surrounded by a rigid shield 155. The shield also encloses a collar end of each pneumatic cylinder, opposite the manifold plate 154, for retaining these cylinders 136 in a spaced-apart and parallel alignment. The sleeve 138 is also affixed to the shield 155 and extends in a parallel relationship with the cylinders 136. The shield 155 has one or more slots 158 on the outside surface thereof for mating with one or more similar ribs (not shown) inside the membrane 134, and for indexing and retaining the membrane thereon.

Figure 8:
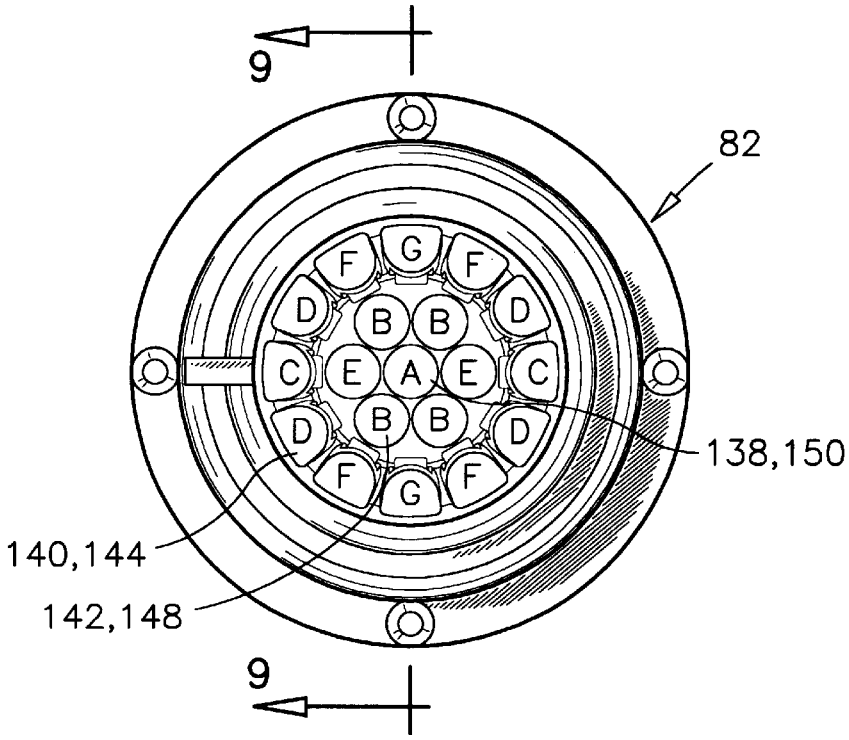
FIG. 8 shows a plan view of the lapping tool head without the covering membrane.
Figure 13:
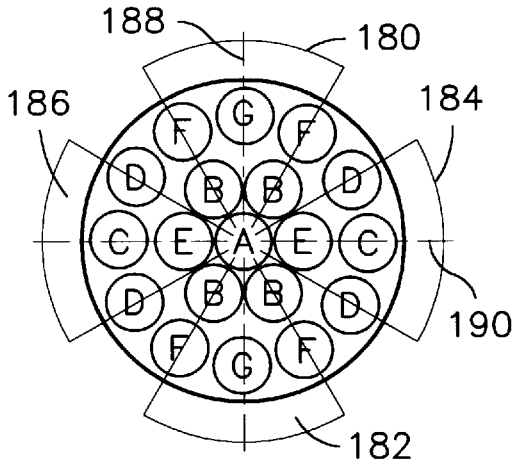
FIG. 13 is a schematic plan view of the lapping tool head illustrating the various pressure zones therein when these pressure zones are operable in diametrically opposite sectors.
Figure 14:
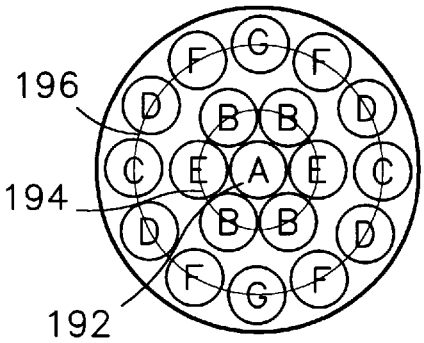
FIG. 14 is another schematic plan view of the lapping tool head illustrating the various pressure zones therein when the pressure zones are operable in concentric circles.

The manifold plate 154 has six (6) circuit grooves 156 therein connecting one or more cylinders 136 to one of six (6) holes 158 communicating with one of six (6) pressure supply fittings 160 extending from a base plate 162 of the tool head 82. The base plate 162 is mountable to the arbor of the oscillatory mechanism by means of bolts through countersunk holes as illustrated. The six (6) circuit grooves 156 connect two or more cylinders 136 to form with the central stem 150, seven (7) pressure zones of the lapping tool head 82. Each zone is labeled with a letter symbol from 'A' to 'G' as illustrated in FIGS. 8, 13 and 14.

Each of the supply fittings 160 is connected to a solenoid operated pneumatic valve 164 which in turn is connected to an air pressure supply manifold 166. There is provided on the supply port to the air pressure supply manifold 166, a precision proportional pressure regulator 168. The pressurizing of each cylinder 136 is effected by operating one solenoid valve 164 at the time and changing the pressure setting of the pressure regulator 168 at each time. The pressure regulator 168 is a computer-controlled, fast-response type where the closing and pressurizing of all six lines are effected in a very short time and in fact in few seconds. The pressure in each cylinder 136 is preferably adjusted repeatedly during the entire period of operation of the lapping tool head. When the inner plungers 142 are used under a vacuum, a similar circuit (not shown) is used for controlling the vacuum setting in these plungers, in the caps 148 of these plungers or in both the plungers 142 and the caps 148.

Referring back to FIG. 10, a seventh circuit groove 170 and a seventh hole 172 are shown in the manifold plate 154. This circuit groove is also connected to a pressure supply fitting 160 and to the air pressure supply manifold 166 and regulator 168. The circuit groove 170 is connected to an access hole 174 through a central region of the tool head 82 as illustrated in FIG. 9. The membrane 134 is preferably sealed around the shield 155, in groove 176 for example as shown in FIGS. 6 and 9. When air pressure is admitted through conduit 174, this pressure is transmitted inside the tool head and under the membrane 134 to inflate the membrane. A slight positive pressure inside the membrane is at time advantageous for reducing localized pressure concentration areas at each plunger 140 or 142. Similarly, it will be appreciated that a vacuum may also be applied to the circuit groove 170 for obtaining extreme curvatures in the membrane 134 for example.

Figure 12:
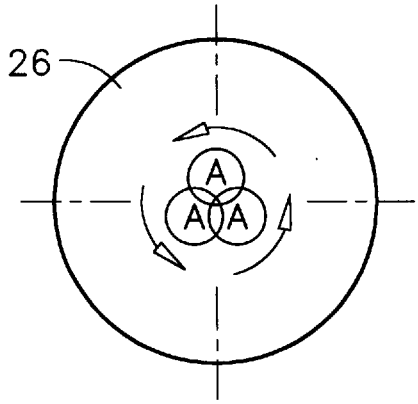
FIG. 12 is a schematic illustration representing an ideal path of the lappig tool head on an ophthalmic lens.

Referring now to FIG. 12, the triple illustrations of zone 'A' on this drawing is representative of the travel of the central area of the tool head 82 during the polishing of a lens. While only zone 'A' is illustrated therein, the illustration is intended to depict the movement of the entire tool head 82 against the surface of the lens 26. The diameter and velocity of the oscillatory movement is preferably adjustable. A satisfactory diametrical setting on the apparatus of the preferred embodiment is between about 10 to about 20 mm and a preferred velocity is between about 300 and 600 cycles per minute for polishing a lens having a diameter of about 75 mm.

In order to better appreciate the operation of the lapping tool head 82, reference may now be made to FIG. 13. This figure illustrates a plan view of the lapping tool head 82 and the seven regions defined by the stem 150 and the plungers 140,142. The configuration of these regions is such that it is possible to group one or more zones to define four sectors as illustrated in this figure. Sectors 180 and 182 are opposite and symmetrical. Sectors 184 and 186 are also opposite and symmetrical, and disposed at right angle with sectors 180 and 182.

Sectors 180 and 182 are disposed along the axis 188 of the cross curve of a lens to be polished on that head for example, herein referred to as the cross curve axis. Similarly, the sectors 184 and 186 are disposed along the base curve axis 190. It will be appreciated that all zones on one side of the cross curve axis 188 are positioned in a symmetrical manner relative to the zones of the other side of that axis. Similarly, the position of the zones on one side of the base curve axis 190 are symmetrical to the zones of the other side of that axis. Therefore, each zone on the lapping tool head is positioned in a four-way symmetrical arrangement relative to the commonality of that zone with both orthogonal axes 188 and 190 of the lapping tool head. The advantages of this configuration of the pressure zones on the lapping tool head 82 will become more apparent in the light of the following description.

The pressure settings of the pressure zones defined by sectors 180 and 182 are adjustable according to the shape of the cross curve of the prescribed lens to be polished. Similarly the pressure settings in the regions defined by sectors 184, and 186 are adjustable according to the shape of the base curve of the prescribed lens. The ability to create pressure gradients along two pairs of opposite sectors has proven to be advantageous for shaping right-angled profiles in the membrane 134 of the tool head 82 according to both basic curvatures of a lens 26, and thereby obtaining uniform polishing of the lens surface.

Another important characteristic of the lapping tool head 82 of the preferred embodiment is illustrated in FIG. 14 and is also directly related to the symmetrical arrangement of the pressure zones on the tool head. The eighteen (18) pneumatic cylinders 136 of the tool head 82 are arranged in seven zones as it was previously mentioned for forming four (4) symmetrical sectors 180,182,184,186. The seven zones are also configured to form three (3) concentric circles or three concentric hexagons. However, for maintaining the clarity of the text, reference will be made to concentric circles. The first circle 192 comprises a single zone 'A' having a fixed stem 150. The second circle 194 comprises two zones; 'B' and 'E' having respectively four and two pneumatic cylinders 136. The third circle 196 comprises four zones; 'C', 'D', 'F' and 'G' having respectively two cylinders, four cylinders, four cylinders and two cylinders. Each cylinder 136 in each of zones 'B' to 'G' is diametrically and symmetrically opposite from another cylinder in a same zone.

The pressure in all the pneumatic cylinders along each circle 194 and 196, or the vacuum setting in plungers 142 in circle 194, may be periodically reduced from, or increased above their prescribed settings, to cause the membrane 134 to flex at controlled locations and to cause the membrane to undulate against the surface of the lens 26. The circular arrays 194 and 196 are workable separately and in sequence to pump in a nominal quantity of abrasive slurry toward the center of the lens 26, or to expel slurry from the central region of the lens toward the periphery of the lens. This controlled undulation of the membrane 134 and the pumping action created thereby is advantageous for maintaining a constant supply of abrasive slurry across the entire surface of the lens.

Because the zones comprised in each circle are diametrically symmetrical in relation to the configuration of the lapping tool head, and because each zone may be actuated for a specific time duration, the polishing effect of the tool head during the undulation of the membrane is controllable to ensure a uniform polishing action across the entire surface of the lens.

It will be appreciated that the pumping action by way of undulating the membrane in pulsating circular waves may be preferred by some users when the curvature of the membrane is near a maximum value. When the lens' curvature is nearly flat, however, the pressure gradient in each pair of sectors 180–182 and 184–186 may be alternatively varied for generating pulsating radial waves in the membrane 134 and for undulating the membrane 134 in a sweeping-like manner to take in and spread the abrasive slurry over the entire surface of the lens.

It has been found that whether the membrane is periodically undulated in a circular wave mode or in radial wave mode, the efficiency of the polishing action is enhanced significantly. It will be appreciated that the pulsating undulating action of the membrane is preferably superimposed over the prescribed pressure settings of each cylinder. Hence, the programmed curvature of the membrane 134 is always maintained before and after the formation of each wave and at the nodes of each wave.

Although the pulsating effect described herein is known to greatly improve a lens polishing operation, those who are familiar with lens polishing processes will appreciate that the pulsating effect described herein does not necessarily obviate completely the need to periodically raise the lens off the lapping tool head to renew the layer of lapping slurry there-between.

As to a more elaborated manner of usage and operation of the apparatus according to the preferred embodiment, the same should be apparent from the above description, and accordingly further discussion relative to the manner of usage and operation would be considered redundant and is not provided.

While one embodiment of the present invention has been illustrated in the accompanying drawings and described hereinabove, it will be appreciated by those skilled in the art that various modifications, alternate constructions and equivalents may be employed without departing from the true spirit and scope of the invention. Therefore, the above description and the illustrations should not be construed as limiting the scope of the invention which is defined by the appended claims.

I claim:

1. An improved method for polishing an ophthalmic lens surface using an apparatus having a lapping tool head, a flexible membrane covering a lapping portion of said tool head, and pump and nozzle means for pumping abrasive slurry over said lapping tool head; said method comprising the conventional step of:

imparting an oscillatory movement to said lapping tool head and contacting said lens surface with said lapping portion of said lapping tool head while an abrasive slurry is pumped over said lapping tool head and on said lens, and wherein the improvement comprises the additional step of:

periodically undulating said membrane for imparting a wave in said membrane such that said abrasive slurry can flow between said membrane and said lens surface.

2. The method as claimed in claim 1, wherein said tool head is circular and said step of periodically undulating said membrane for imparting a wave in said membrane comprises the step of imparting a radial wave in said membrane.

3. The method as claimed in claim 1, wherein said tool head is circular and said step of periodically undulating said membrane for imparting a wave in said membrane comprises the step of imparting a circular wave in said membrane.

4. The method as claimed in claim 1, wherein said lapping tool head has a neutral axis, and said method further includes the step of moving said ophthalmic lens surface back and forth and side to side relative to said neutral axis.

5. The method as claimed in claim 1, wherein said lapping tool head has a neutral axis, and said method further includes the steps of shaping said membrane along a pair of right angled axes perpendicular to said neutral axis, and forming profiles in said membrane along said axes, similar to a base and cross curvatures of said lens respectively.

6. The method as claimed in claim 5, wherein said membrane profiles are maintained before and after each said wave, and at a node of each said wave.

7. The method as claimed in claim 5, wherein said step of shaping said membrane includes the step of simultaneously pushing and pulling against said membrane relative to said lapping tool head.

8. The method as claimed in claim 5, wherein said step of shaping said membrane includes the step of slightly inflating said membrane.

9. The method as claimed in claim 5, wherein said step of periodically undulating said membrane for imparting a wave in said membrane comprises the step of continually maintaining a portion of said membrane in contact with said ophthalmic lens surface.

10. A lapping tool head for polishing an ophthalmic lens, comprising:

a base plate having mounting means for securement thereof to a lens polishing apparatus, and a plurality of pneumatic fittings mounted therein;

a manifold plate affixed to said base plate and having pneumatic circuits therein with each of said pneumatic circuits communicating with one fitting in said plurality of fittings;

a plurality of pneumatic cylinders affixed to said manifold plate, and defining a circular array of parallelly-aligned cylinders, with each said cylinder being connected in a sealed communication with a respective one of said pneumatic circuits;

a shield encircling all said cylinders, and individually enclosing an extremity of each said cylinder opposite said manifold plate;

an elongated sleeve immovably affixed to said shield in a central region of said circular array, and being aligned with said cylinders;

a flexible membrane covering said cylinders and said shield, said membrane having a stem extending from said membrane into said sleeve and being secured into said sleeve; and said cylinders each having an extendible end movable against said flexible membrane for shaping said membrane;

such that when said fittings are adapted to be connected to respective sources of air pressure, said cylinders are individually controllable for shaping said membrane according to a curvature of an ophthalmic lens, and when said membrane is brought in contact with an ophthalmic lens, a central portion of said membrane is usable as a reference contact point for positioning said membrane against said ophthalmic lens with a selected pressure between said membrane and said ophthalmic lens.

11. The lapping tool head as claimed in claim 10, wherein said array of cylinders comprises an inner and outer concentric circles around said sleeve.

12. The lapping tool head as claimed in claim 10, wherein said pneumatic circuits in said manifold plate comprises one circuit communicating inside said membrane for inflating said membrane.

13. The lapping tool head as claimed in claim 10, wherein said array is divisible in two pairs of opposed segments thereof and said pneumatic circuits are commonly connectional to said pneumatic cylinders in each said pair.

14. The lapping tool head as claimed in claim 13, wherein said pneumatic circuits are also commonly connectional to said pneumatic cylinders in each said circle.

15. The lapping tool head as claimed in claim 10, wherein said extendible ends on said cylinders in said outer circle each has a D-shaped pad mounted thereon, with a short segment of said D-shaped pad extending along a circumference of said circular array, and said pad being pivoted on said extendible end along an axis aligned with said circumference of said circular array.

16. The lapping tool head as claimed in claim 15, wherein said extendible ends in said cylinders in said inner circle have suction-cup-shaped caps mounted thereon.

17. An apparatus for polishing an ophthalmic lens, comprising:

a lens polishing station having an lapping tool head; means for imparting an oscillatory movement to said lapping tool head, means for retaining an ophthalmic lens in contact with said lapping tool head and against said oscillatory movement; and means for pumping lapping slurry over said lapping tool head;

said lapping tool head having a flexible membrane mounted thereon and means mounted under said membrane for periodically undulating said membrane;

such that when said lapping tool head is adapted to be oscillated across a surface of an ophthalmic lens, when lapping slurry is adapted to be pumped over said membrane, and when said membrane is adapted to be periodically undulated, said slurry is able to move between said membrane and said surface for efficiently polishing said surface.

18. The polishing apparatus as claimed in claim 17, wherein said means for undulating said membrane comprises means for forming radial waves in said membrane.

19. The polishing apparatus as claimed in claim 17, wherein said means for undulating said membrane comprises means for forming circular waves in said membrane.

20. The polishing apparatus as claimed in claim 17, wherein said means for undulating said membrane comprises means for shaping said membrane along a pair of perpendicular axes.

* * * * *